US008521070B2

(12) United States Patent
Ichikawa

(10) Patent No.: US 8,521,070 B2
(45) Date of Patent: Aug. 27, 2013

(54) TONER CARTRIDGE AND IMAGE FORMING APPARATUS INCLUDING THE SAME

(75) Inventor: Yoshiki Ichikawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 336 days.

(21) Appl. No.: 13/040,660

(22) Filed: Mar. 4, 2011

(65) Prior Publication Data

US 2011/0222917 A1 Sep. 15, 2011

(30) Foreign Application Priority Data

Mar. 12, 2010 (JP) ..... 2010-056250

(51) Int. Cl.
*G03G 15/08* (2006.01)

(52) U.S. Cl.
USPC ..... 399/263; 399/102; 399/105

(58) Field of Classification Search
USPC ..... 399/263
See application file for complete search history.

(56) References Cited

U.S. PATENT DOCUMENTS 5,235,130 A * 8/1993 Demoto et al. ..... 399/103
5,264,901 A * 11/1993 Rossiter ..... 399/105
5,402,216 A * 3/1995 Komaki et al. ..... 399/260
5,749,026 A * 5/1998 Goldie ..... 399/103
6,009,287 A * 12/1999 Goldie ..... 399/103
7,555,250 B2 6/2009 Nagae et al.
2002/0064401 A1* 5/2002 Ashikari ..... 399/258
2007/0172252 A1* 7/2007 Koyama et al. ..... 399/106
2008/0240772 A1* 10/2008 Nishikawa ..... 399/106
2008/0298834 A1* 12/2008 Hasegawa ..... 399/106
2009/0169241 A1* 7/2009 Mimura ..... 399/106
2010/0003056 A1* 1/2010 Ishiguro et al. ..... 399/262
2011/0002715 A1* 1/2011 Ishiguro et al. ..... 399/263

FOREIGN PATENT DOCUMENTS

JP 07-110619 4/1995
JP 2000-214667 8/2000
JP 2005-049673 2/2005

* cited by examiner

*Primary Examiner* — Walter L Lindsay, Jr.
*Assistant Examiner* — David Bolduc
(74) *Attorney, Agent, or Firm* — Nixon & Vanderhye, P.C.

(57) ABSTRACT

A toner cartridge comprises a toner cartridge body, a screw shaft, a paddle member, and a toner inflow block piece coupled to a part of the paddle member. The toner cartridge body comprises a toner storage section where the paddle member is disposed and a toner conveying passage The toner conveying passage, where the screw shaft is stored is adjacent to and communicates with the toner storage section. The toner inflow block piece is disposed at an end on a toner discharge port side of an agitating blade of the paddle member so as to project in a direction perpendicular to a rotary shaft of the screw shaft and has a cutout recess for the rotary shaft of the screw shaft to fit in.

15 Claims, 7 Drawing Sheets

TONER CARTRIDGE AND IMAGE FORMING APPARATUS INCLUDING THE SAME

CROSS-REFERENCE TO RELATED APPLICATION

This application is related to Japanese patent application No. 2010-56250 filed on Mar. 12, 2010 whose priority is claimed under 35 USC §119, the disclosure of which is incorporated by reference in its entirety.

BACKGROUND OF THE INVENTION

1. Field of the Invention

The present invention relates to a toner cartridge replaceably attached to an electrophotographic image forming apparatus, and to an image forming apparatus including the same.

2. Description of the Related Art

Conventionally, electrophotographic image forming apparatuses such as copiers, printers, and facsimile machines, which use dual-component developers, are each capable of continuously driving to output images by being automatically supplied with a toner from a toner discharge port of a toner cartridge replaceably attached to an apparatus body to a developing section of the apparatus.

As shown in FIG. 10, what has been proposed as such a toner cartridge 300 is the one including: a toner cartridge body 301 having a toner discharge port 304*a*; a shutter 303 provided on the outer surface side of the toner cartridge body 301 for opening and closing the toner discharge port 304*a*; an auger screw 302 rotatably provided in the toner cartridge body 301 for conveying a toner T in the toner cartridge body 301 to the toner discharge port 304*a*; and a paddle member 306 rotatably provided in the toner cartridge body 301 so as to be in parallel to a rotary shaft 302*a* of the auger screw 302 for sending the toner T in the toner cartridge body 301 toward the auger screw 302, in which the toner discharge port 304*a* is disposed on one end side in a longitudinal direction of the toner cartridge body 301.

As a device that resembles the toner cartridge shown in FIG. 10, what has been proposed is the one disclosed in Japanese Unexamined Patent Publication No. 2000-214667, for example.

In a case where the toner cartridge 300 shown in FIG. 10 is stored upright with the toner discharge port 304*a* facing downward, the toner T in the toner cartridge body 301 sinks down under its own weight over the course of time, and hence a toner density around the toner discharge port 304*a* becomes high. As a result, there arises a problem that the toner T around the toner discharge port 304*a* flocculates, and eventually forms lumps, to clog the toner discharge port 304*a*. It is to be noted that any part in FIG. 10 where black dots appear densely represents such a flocculated toner T or a lump of the toner T.

While the manufacturers recommend users not to store the toner cartridge 300 in such an upright state, in some cases, this is not complied with.

Depending on vibrations or load conditions of the toner cartridge 300 during transportation, the toner density around the toner discharge port 304*a* may become high to result in the flocculation.

In a case where the toner cartridge 300 whose toner discharge port 304*a* is clogged with such a flocculated toner T or lumps of the toner T is attached to the apparatus body of the image forming apparatus, the toner T is not easily discharged from the toner cartridge 300. This may cause the apparatus body to determine that the toner has run out, even when a large amount of the toner T remains in the toner cartridge 300.

Further, the flocculated toner T or lumps of the toner T around the toner discharge port 304*a* may be compressed and thus solidifies under the pressure of the auger screw 302, resulting in a failure of the auger screw 302 being locked.

Accordingly, as to an attachment of a new toner cartridge to the apparatus body, the manufacturers recommend the users to follow a precaution of shaking the toner cartridge for several times before attaching it. However, in some cases, this is not complied with.

Further, because a recently toner has its fusing performance under low temperatures improved for the energy-saving purpose, its storage stability is reduced, and hence such a toner is prone to the toner flocculation when left at an ambient temperature.

Still further, in accordance with the miniaturization demanded for recently image forming apparatuses, the toner cartridge also is subjected to miniaturization, and hence the toner cartridge body is tightly packed with the toner. Therefore, the toner flocculation is prone to occur.

The toner cartridge disclosed in Japanese Unexamined Patent Publication No. 2000-214667 is directed to prevent the toner flocculation by partially cutting a helical blade of the auger screw on the toner discharge port side, so as to reduce the pressure applied by the auger screw to the toner on the toner discharge port side when the toner is conveyed. However, this cannot address the toner flocculation that occurs when the toner cartridge is stored upright with the toner discharge port facing downward.

SUMMARY OF THE INVENTION

The present invention has been made to solve the problem described above, and an object thereof is to provide a toner cartridge with which flocculation of a toner on a toner discharge port side is prevented, which would otherwise occur depending on storage conditions, and an image forming apparatus including the same.

Accordingly, the present invention provides: a toner cartridge, including:

a toner cartridge body formed into a shape of a hermetic container elongated in one direction and having a toner discharge port on an one end side in a longitudinal direction of the toner cartridge body;

a shutter provided on an outer surface side of the toner cartridge body for opening and closing the toner discharge port;

a screw shaft provided in the toner cartridge body rotatably about a rotary shaft in the longitudinal direction for conveying a toner in the toner cartridge body to the toner discharge port;

a paddle member for sending the toner in the toner cartridge body toward the screw shaft, the paddle member having in the toner cartridge body a rotary shaft being in parallel to the rotary shaft of the screw shaft and an agitating blade attached to the rotary shaft; and a toner inflow block piece coupled to a part of the paddle member, wherein the toner cartridge body includes therein a toner storage section being a large-capacity space where the paddle member is disposed and most of the toner is stored; and a toner conveying passage being a small-capacity space where the screw shaft is disposed, the toner conveying passage being adjacent to and communicating with the toner storage section and having the toner discharge port disposed on an one end side in a longitudinal direction of the toner conveying passage, the toner inflow block piece is disposed at a block position where an inflow of the toner in the toner conveying passage toward the toner discharge port is blocked while the toner cartridge body is yet to be attached to an image forming apparatus, and rotates together with the paddle member so as to be away from the block position while the toner cartridge body is attached to the image forming apparatus.

According to the present invention, even when the toner cartridge is stored upright with the toner discharge port facing downward, thanks to the toner inflow block piece, the toner will not easily flow into the space on the toner discharge port side of the toner conveying passage. Therefore, even when the toner cartridge is stored for a long period of time in this state, the toner is prevented from flocculating around the toner discharge port.

This holds true to a situation where the toner cartridge is shaken during transportation.

As a result, it becomes possible to solve the problems of an erroneous detection made by the apparatus body of the image forming apparatus that the toner has run out, and the auger screw being locked and failed.

Further, after the toner cartridge is attached to the apparatus body and when the toner is supplied from the toner cartridge to the developing section of the image forming apparatus, the toner inflow block piece rotates with the paddle member so as to be away from the block position. Therefore, the space of the toner conveying passage on the toner discharge port side is automatically opened, and the toner can be conveyed by the screw shaft to the toner discharge port.

That is, a special mechanism for opening the toner inflow block piece can be dispensed with, and the toner cartridge of a compact design can be provided.

DETAILED DESCRIPTION OF THE PREFERRED EMBODIMENTS

Figure 1:
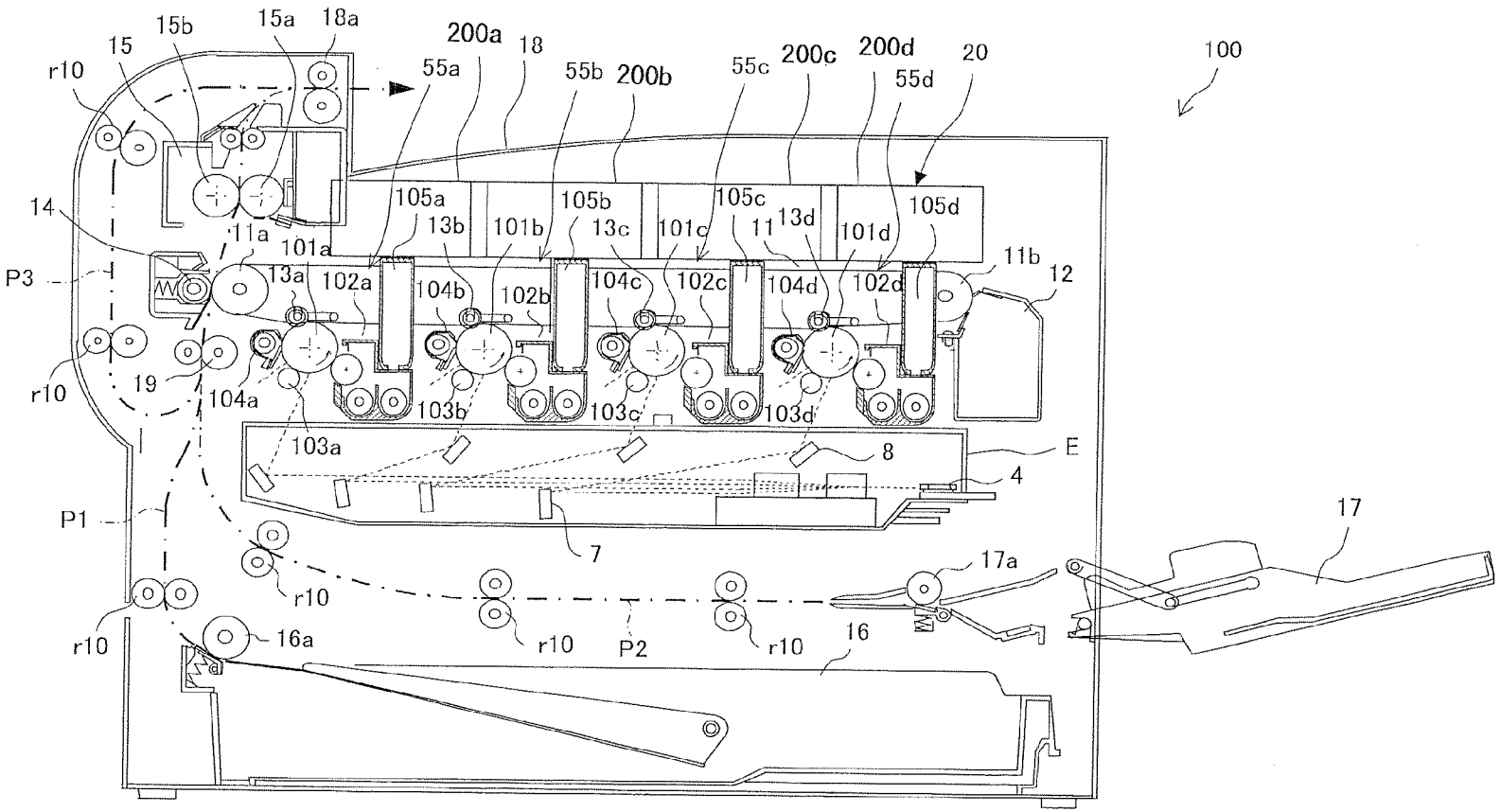
FIG. 1 is an explanatory illustration showing an overall constitution of an image forming apparatus according to a first embodiment of the present invention.

A toner cartridge according to the present invention includes, as described earlier: the toner cartridge body having the toner discharge port on the one end side in the longitudinal direction; the shutter for opening and closing the toner discharge port; the screw shaft for conveying the toner in the toner cartridge body to the toner discharge port; the paddle member for sending the toner in the toner cartridge body toward the screw shaft; and the toner inflow block piece provided at the paddle member. The toner cartridge is removably (replaceably) attached to an apparatus body of an electrophotographic image forming apparatus such as a copier, a printer, a facsimile machine, and a multi function peripheral possessing their functions, all of which are capable of forming monochrome or full-color images.

Further, the toner cartridge may be constituted in the following modes, which may be used in combination.

(1) The toner cartridge body is formed into a shape in which the toner conveying passage projects toward the one end side in the longitudinal direction farther than the toner storage section does, the toner discharge port is disposed in a projection space of the toner conveying passage projecting toward the one end side in the longitudinal direction farther than the toner storage section does, and the block position of the toner inflow block piece is located at an opening of the projection space, the opening facing the toner storage section.

This mode makes it possible to dispose the toner inflow block piece at an effective block position with respect to any existing toner cartridge body in which the toner discharge port is disposed in the projection space. As a result, in the toner cartridge before being attached to the apparatus body of the image forming apparatus, an inflow of the toner toward the toner discharge port can more effectively be blocked, and hence the toner flocculation around the toner discharge port can more effectively be prevented.

(2) The toner inflow block piece is disposed at an end on a toner discharge port side of the agitating blade of the paddle member so as to project in a direction perpendicular to the rotary shaft of the screw shaft and has a cutout recess for the rotary shaft of the screw shaft to fit in.

This mode makes it possible to block the inflow of the toner into the projection space of the toner conveying passage with the toner inflow block piece in a simple structure, and removal of the toner inflow block piece from the screw shaft can be carried out with ease.

(3) The agitating blade of the paddle member and the toner inflow block piece are integrally formed with a flexible sheet member.

This mode makes it possible to manufacture the toner inflow block piece while dispensing with any member coupling the toner inflow block piece to the paddle member.

Further, because the paddle member and the toner inflow block piece can elastically be deformed, even when they are brought into contact with an inner wall surface, the screw shaft, and the like in the toner cartridge body, their rotation will not be disturbed, and a drive section driving them will not be overloaded.

Further, because the paddle member is flexible, it becomes possible to rotate the paddle member while bringing the paddle member into sliding contact with a bottom of the toner storage section, to thereby send the toner into the toner conveying passage without any loss.

(4) In the mode (3), the toner inflow block piece is formed by folding an end of the agitating blade of the paddle member, and a cutout is formed at a boundary portion between the agitating blade and the toner inflow block piece.

In this mode, the flexibility (bendability) of the agitating blade will not be impaired while the agitating blade and toner inflow block piece are maintained to be integrated with each other.

In this case, a length of the cutout being shorter than that of a joint portion between the agitating blade and the toner inflow block piece is preferable in improving the flexibility of the agitating blade.

(5) The toner inflow block piece has a cutout recess for the rotary shaft of the screw shaft to fit in, and is coupled to a part of the paddle member by a tape or a strap.

That is, this mode is different from the mode (2) in that the toner inflow block piece is formed separately from the paddle member so as to be coupled to the part of the paddle member by the tape or the strap.

This mode makes it possible to use any existing paddle member, and to allow the paddle member to rotate without interfering with the toner inflow block piece.

(6) The toner inflow block piece is coupled to the rotary shaft of the paddle member by a tape or a strap.

In this mode, as the paddle member rotates, the tape or the strap is taken up to allow the toner inflow block piece to be retracted to the position of the rotary shaft. Therefore, it is advantageous in that the toner inflow block piece does not disturb the rotation of the paddle member.

In the following, with reference to the drawings, a description will be given of embodiments of the present invention. It is to be noted that the present invention is not limited to the following embodiments.

(First Embodiment)

FIG. 1 is an explanatory illustration showing an overall constitution of an image forming apparatus according to a first embodiment of the present invention.

As shown in FIG. 1, an image forming apparatus 100 according to the first embodiment includes four image forming sections 55 (55*a* to 55*d*), and characterized in that it employs toner cartridges 200 (200*a* to 200*d*), whose description will be given later, respectively provided to the image forming sections 55.

It is to be noted that, in the first embodiment, the description will be given of an exemplary printer that forms a multi-color or single-color image as a visible image on a prescribed sheet (recording paper) based on image data included in an input command such as image data transmitted from outside via a communication network. However, the image forming apparatus may be any one of a copier, a facsimile machine, and a multi function peripheral possessing their functions, each of which is capable of forming a multi-color or single-color image on a recording medium based on image data transmitted from outside and/or image data read by a scanner from an original text.

<Overall Constitution of Image Forming Apparatus>

First, the overall constitution of the image forming apparatus 100 will be detailed.

As shown in FIG. 1, the image forming apparatus 100 according to the first embodiment includes an exposure unit E, the four image forming sections 55 (55*a* to 55*d*), an intermediate transfer belt 11, primary transfer rollers 13 (13*a* to 13*d*), a secondary transfer roller 14, a fusing device 15, sheet conveying paths P1, P2, and P3, a sheet feed cassette 16, a manual sheet feed tray 17, a sheet exit tray 18, a toner cartridge unit 20, and the like.

The image forming sections 55 (55*a* to 55*d*) respectively include photoconductor drums 101 (101*a* to 101*d*) each corresponding to an image bearer on which a latent image is formed by the exposure unit E, developing devices 102 (102*a* to 102*d*), charge rollers 103 (103*a* to 103*d*), cleaner units 104 (104*a* to 104*d*), and the like.

Image data of a multi-color image handled by the image forming apparatus 100 corresponds to four hues of black (K), cyan (C), magenta (M), and yellow (Y), based on which image data a visible image is formed by the image forming sections 55 (55*a* to 55*d*).

Accordingly, in order to form four types of latent images corresponding to respective colors, the image forming sections 55 (55*a* to 55*d*) are each provided with corresponding one of the developing devices 102 (102*a* to 102*d*), corresponding one of the photoconductor drums 101 (101*a* to 101*d*), corresponding one of the charge rollers 103 (103*a* to 103*d*), corresponding one of the transfer rollers 13 (13*a* to 13*d*), and corresponding one of the cleaner units 104 (104*a* to 104*d*).

The image forming sections 55 (55*a* to 55*d*) are arranged to form a line in a shift direction (sub-scan direction) of the intermediate transfer belt 11.

It is to be noted that, because the image forming sections 55*a* to 55*d* are of the same constitution, in the present description, the image forming sections may collectively be denoted by a uniform reference numeral 55; the photoconductor drums respectively provided to the image forming sections may collectively be denoted by a uniform reference numeral 101; the developing devices may collectively be denoted by a uniform reference numeral 102; the charge rollers may collectively be denoted by a uniform reference numeral 103; the transfer rollers may collectively be denoted by a uniform reference numeral 13; and the cleaner units may collectively be denoted by a uniform reference numeral 104. Further, as to the reference characters "a" to "d", "a" corresponds to black; "b" corresponding to cyan; "c" corresponding to magenta; and "d" corresponding to yellow. The aforementioned means identified by such reference characters constitute respectively four image forming stations.

The exposure unit E serving as an exposure device includes a not-shown semiconductor laser, a polygon mirror 4, first reflection mirrors 7, and second reflection mirrors 8, and the like, so as to irradiate the photoconductor drums 101*a* to 101*d* with light beams such as laser beams modulated by image data pieces of the respective hues, namely, black, cyan, magenta, and yellow. On the photoconductor drums 101*a* to 101*d*, there are formed electrostatic latent images based on the image data pieces of the respective hues, namely, black, cyan, magenta, and yellow.

In the present embodiment, the exposure unit E is of a scheme using a laser scanning unit (LSU) including a laser emitter and the reflection mirrors. However, there may be employed a different scheme which uses arrays of light emitting elements, such as EL and LED writing heads.

The photoconductor drums 101 each serve as a substantially cylindrical image bearer are disposed above the exposure unit E. The photoconductor drums 101 are each controlled to rotate in a prescribed direction by driving means and control means, each of which is not shown.

The photoconductor drums 101 are each structured to include a base formed with a metal drum made of, for example, aluminum or the like, and a thin-film photoconductive layer overlaid on an outer circumferential surface of the base, the thin-film photoconductive layer being made of amorphous silicon (a-Si), selenium (Se), organic photoconductor (OPC) or the like. It is to be noted that the constitution of each of the photoconductor drums 101 is not particularly limited thereto.

The charge rollers 103 are each a contact type charger that uniformly electrifies the surface of the photoconductor drum 101 at a prescribed potential.

As shown in FIG. 1, though the contact roller-type charge rollers 103 are used as the chargers in the first embodiment, a discharging type or brush-type charger may be used in place of each of the charge rollers 103.

The developing devices 102 each supply a toner on the surface of the corresponding one of the photoconductor drums 101 where an electrostatic latent image is formed, so as to develop the electrostatic latent image into a toner image.

The developing devices 102*a* to 102*d* store therein toners in black, cyan, magenta, and yellow, respectively, and visualize the electrostatic latent images formed on the photoconductor drums 101*a* to 101*d* corresponding to the respective hues into toner images in black, cyan, magenta, and yellow.

The cleaner units 104 each remove and collect, by using a lubricant or the like, the toner remaining on the surface of the corresponding one of the photoconductor drums 101 after the development and image transfer processes are carried out.

The intermediate transfer belt 11 disposed above the photoconductor drums 101 is a film having a thickness of about 100 to 150 μm, which is formed in an endless manner. The intermediate transfer belt 11 is suspended in a tensioned state between a drive roller 11*a* and a driven roller 11*b* respectively disposed downstream and upstream in a toner image conveying direction, to form a loop-like shift path.

The photoconductor drums 101 facing a bottom outer circumferential surface of the intermediate transfer belt 11 are disposed in order of the photoconductor drum 101*d*, the photoconductor drum 101*c*, the photoconductor drum 101*b*, and the photoconductor drum 101*a*, from the upstream side in the toner image conveying direction.

On a bottom inner circumferential surface side of the intermediate transfer belt 11, there are disposed the primary transfer rollers 13*a* to 13*d* pressing the bottom outer circumferential surface of the intermediate transfer belt 11 to the photoconductor drums 101*a* to 101*d* while abutting on the bottom inner circumferential surface of the intermediate transfer belt 11. The contact positions on the intermediate transfer belt 11 with respect to the photoconductor drums 101*a* to 101*d* serve as primary transfer positions.

To each of the primary transfer rollers 13*a* to 13*d*, a primary transfer bias whose polarity is opposite to the polarity of the electrostatic charge on the toner is applied under a constant voltage control, so as to transfer the toner images borne on the surfaces of the photoconductor drums 101*a* to 101*d*.

Thus, the toner image of the respective hues formed on the photoconductor drums 101*a* to 101*d* are successively transferred one over another on the outer circumferential surface of the intermediate transfer belt 11, to form a full-color toner image on the outer circumferential surface of the intermediate transfer belt 11.

However, in a case where image data of only a part of the hues of yellow, magenta, cyan, and black is input, the electrostatic latent image and the toner image are formed only on one of the photoconductor drums 101 corresponding to the hue of the input image data, out of the four photoconductor drums 101*a* to 101*d*.

For example, in a monochrome image formation mode, the electrostatic latent image and the toner image are formed only on the photoconductor drum 101*a* corresponding to the black hue, and only the black toner image is transferred to the outer circumferential surface of the intermediate transfer belt 11.

The primary transfer rollers 13*a* to 13*d* are each constituted with a shaft made of metal (e.g., stainless steel) having a diameter of 8 to 10 mm and a conductive elastic material (e.g., EPDM, foamed polyurethane or the like) coated on a surface of the shaft. With the conductive elastic material, a high voltage is uniformly applied to the intermediate transfer belt 11.

In the present embodiment, though the primary transfer rollers 13*a* to 13*d* are used as transfer electrodes, other elements such as brushes can alternatively be used.

The toner images transferred to the outer circumferential surface of the intermediate transfer belt 11 at the primary transfer positions are each conveyed by the rotation of the intermediate transfer belt 11 to a secondary transfer position which faces the secondary transfer roller 14.

In an image forming mode, the secondary transfer roller 14 is pressed against the outer circumferential surface of the intermediate GU transfer belt 11 wrapped around the drive roller 11*a* at a prescribed nip pressure. In order to constantly obtain the nip pressure, one of the secondary transfer roller 14 and the drive roller 11*a* is made of a hard material such as metal, and the other is made of a soft material such as an elastic roller (e.g., an elastic rubber roller, a foamed resin roller, or the like).

When the sheet fed from the sheet feed cassette 16 or the manual sheet feed tray 17 passes the secondary transfer position between the secondary transfer roller 14 and the intermediate transfer belt 11, a high voltage whose polarity is opposite (+) to the polarity (−) of the electrostatic charge on the toner is applied to the secondary transfer roller 14.

Thus, the electrostatic latent images on the photoconductor drums 101*a* to 101*d* are visualized by the toners corresponding to the respective hues, and become the toner images. The toner images are overlaid one another on the intermediate transfer belt 11. Thereafter, the resultant overlaid toner images are conveyed to the secondary transfer position by the rotation of the intermediate transfer belt 11, and the toner images are transferred on the sheet conveyed to the secondary transfer position.

The toner having not been transferred to the sheet and remaining on the intermediate transfer belt 11 causes undesired mixture of the toners in different colors in the following step. Accordingly, the remaining toner is removed and collected by an intermediate transfer belt cleaner unit 12.

The intermediate transfer belt cleaner unit 12 includes a member, for example a cleaning blade, which is brought into contact with the intermediate transfer belt 11. The cleaning blade is disposed so as to be brought into contact with a part of the outer circumferential surface of the intermediate transfer belt 11, which part is supported by the driven roller 11*b*.

The sheet on which the toner images are transferred as a visible image is guided to the fusing device 15 including a heat roller 15*a* and a pressure roller 15*b*, to pass between the heat roller 15*a* and the pressure roller 15*b* so as to undergo heating and pressurizing processes. Thus, the toner images as the visible image is firmly fused on the surface of the sheet.

Then, the sheet on which the toner images are fused is ejected by a sheet exit roller 18*a* onto the sheet exit tray 18.

In the image forming apparatus 100, the sheet conveying path P1 extending in a substantially vertical direction is provided for sending the sheets stored in the sheet cassette 16 to the sheet exit tray 18, through between the secondary transfer roller 14 and the intermediate transfer belt 11 and via the fusing device 15.

Disposed along the sheet conveying path P1 are: a pickup roller 16*a* that picks up the sheets in the sheet cassette 16 one by one to be fed into the sheet conveying path P1; a feed roller r10 that conveys the picked up sheet upward; a registration roller 19 that guides the conveyed sheet between the secondary transfer roller 14 and the intermediate transfer belt 11 at a prescribed timing; and a sheet exit roller 18*a* that ejects the sheet to the sheet exit tray 18.

Further, in the image forming apparatus 100, the sheet conveying path P2 extending from the manual sheet feed tray 17 to the registration roller 19 is provided, along which the pickup roller 17*a* and the feed rollers r10 are disposed.

Still further, the sheet conveying path P3 is formed from the sheet exit roller 18*a* to a point upstream of the registration roller 19 in the sheet conveying path P1.

The sheet exit roller 18*a* is provided so as to be rotatable in both forward and reverse directions. The sheet exit roller 18*a* is driven in the forward direction to eject the sheet onto the sheet exit tray 18 in a simplex image forming mode in which an image is formed on one side of the sheet and in second-side image formation in a duplex image forming mode in which images are formed on both sides of the sheet.

On the other hand, in first-side image formation in the duplex image forming mode, the sheet exit roller 18*a* is driven in the forward direction until a rear end of the sheet passes through the fusing device 15, and is thereafter driven in the reverse direction while clamping the rear end of the sheet, to guide the sheet into the sheet conveying path P3. Thus, the sheet having the image formed on its one side only in the duplex image forming mode is guided to the sheet conveying path P1 in a state having its front and back surfaces as well as front and rear ends respectively reversed.

The registration roller 19 guides the sheet fed from the sheet cassette 16 or the manual sheet feed tray 17, or conveyed from the sheet conveying path P3 between the secondary transfer roller 14 and the intermediate transfer belt 11 at a timing in synchronization with the rotation of the intermediate transfer belt 11.

Accordingly, the rotation of the registration roller 19 is stopped when operations of the photoconductor drums 101 and the intermediate transfer belt 11 are started, and the sheet fed or conveyed prior to the rotation of the intermediate transfer belt 11 stops shifting in the sheet conveying path P1 in a state having its forward end abut on the registration roller 19. Thereafter, the registration roller 19 starts rotating at a timing where the forward end of the sheet and the forward ends of the toner images formed on the intermediate transfer belt 11 face each other at a position where the secondary transfer roller 14 and the intermediate transfer belt 11 are pressed against each other.

It is to be noted that, in a full-color image forming mode in which the image formation is performed at all the image forming sections 55*a* to 55*d*, the primary transfer rollers 13*a* to 13*d* press the intermediate transfer belt 11 against all the photoconductor drums 101*a* to 101*d*. On the other hand, in a monochrome image forming mode in which the image formation is performed only at the image forming section 55*a*, the primary transfer roller 13*a* solely presses the intermediate transfer belt 11 against the photoconductor drum 101*a*.

<Constitution of Toner Cartridge>

Next, with reference to the drawings, a detailed description will be given of a constitution of the characteristic toner cartridges 200 according to the first embodiment.

Figure 2:
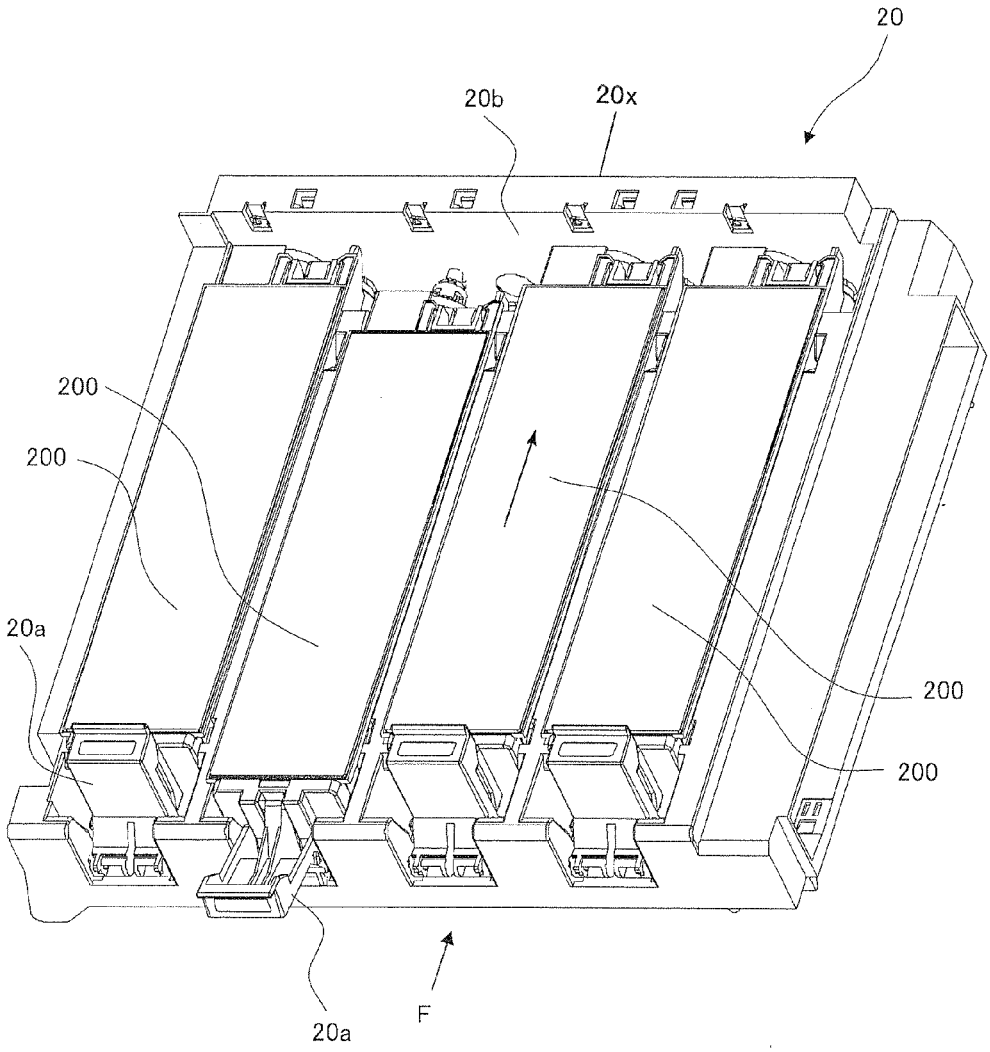
FIG. 2 is a perspective view showing a constitution of a toner cartridge unit including toner cartridges, which is installed in the image forming apparatus according to the first embodiment.

FIG. 2 is a perspective view showing the constitution of a toner cartridge unit including the toner cartridges, which is installed in the image forming apparatus according to the first embodiment.

Figure 3:
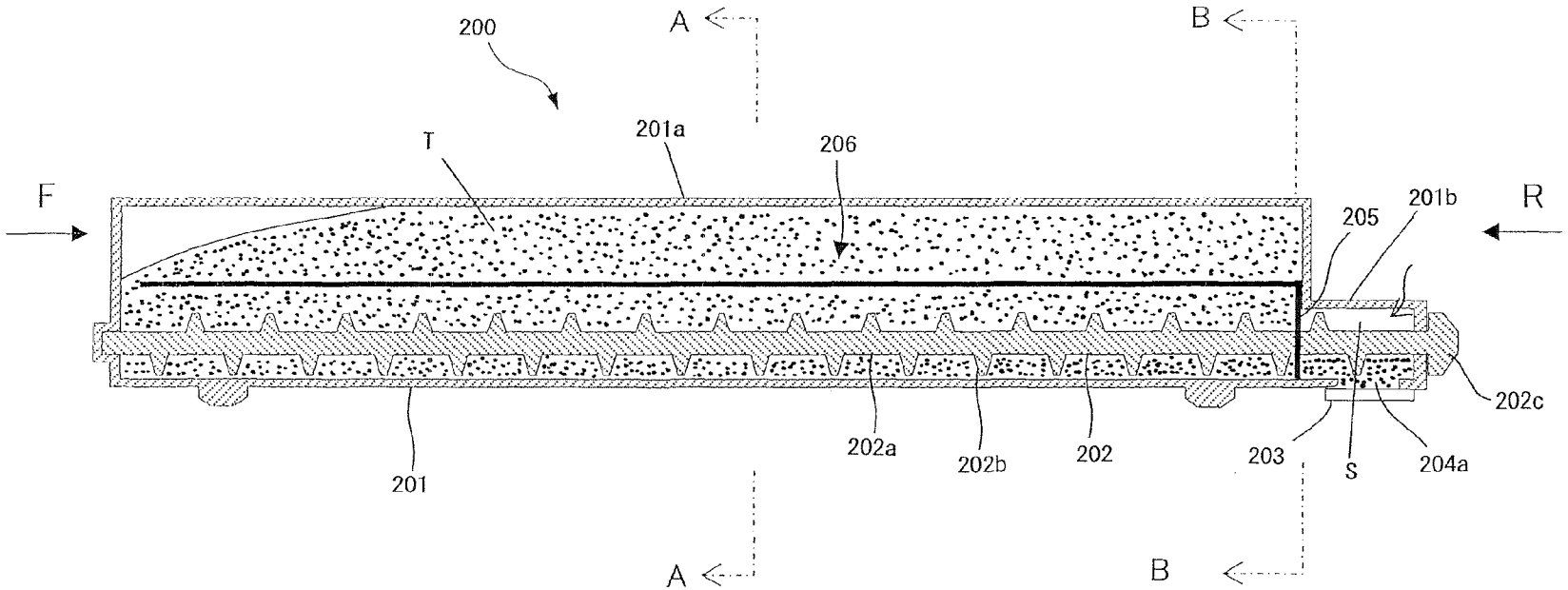
FIG. 3 is a side cross-sectional view showing a state before the toner cartridge according to the first embodiment is attached to the image forming apparatus.
Figure 4:
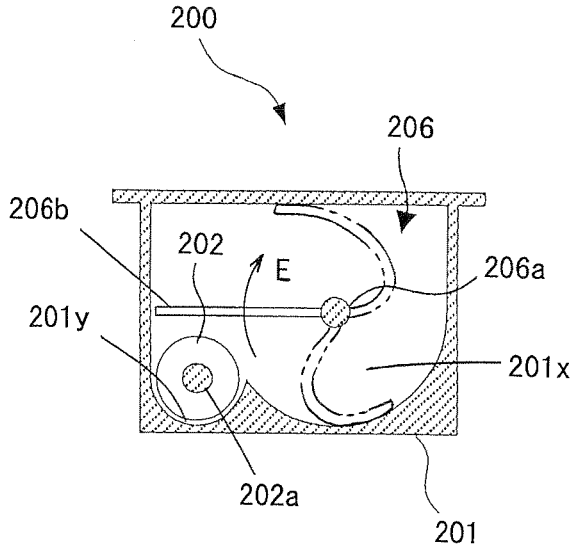
FIG. 4 is a cross-sectional view of the toner cartridge shown in FIG. 3 taken along line A-A.
Figure 5:
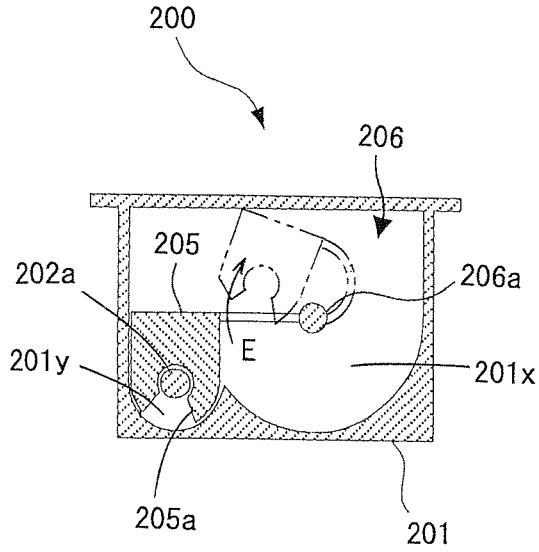
FIG. 5 is a cross-sectional view of the toner cartridge shown in FIG. 3 taken along line B-B.
Figure 6:
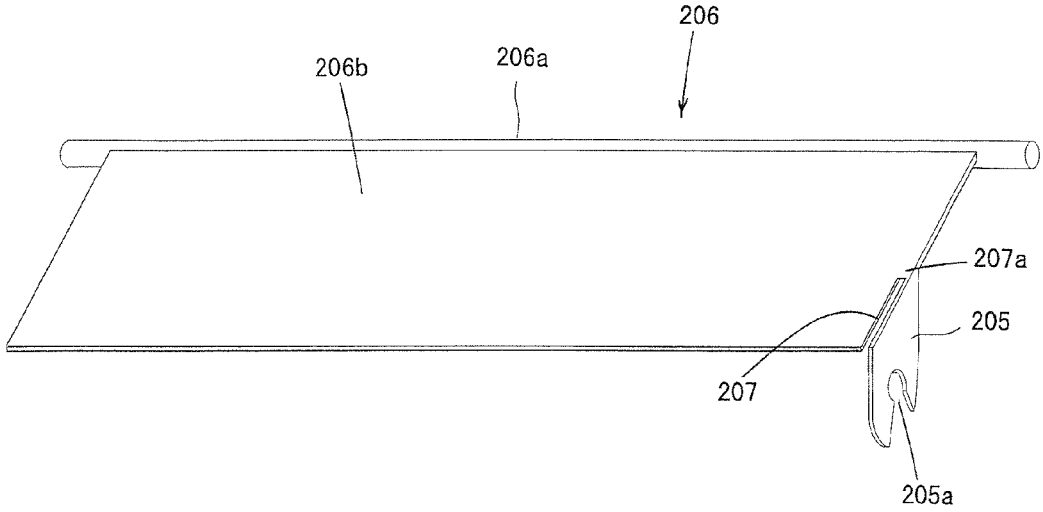
FIG. 6 is a perspective view of a paddle member of the toner cartridge according to the first embodiment.

FIG. 3 is a side cross-sectional view showing a state before the toner cartridge according to the first embodiment is attached to the image forming apparatus. FIG. 4 is a cross-sectional view of the toner cartridge shown in FIG. 3 taken along line A-A. FIG. 5 is a cross-sectional view of the toner cartridge shown in FIG. 3 taken along line B-B. FIG. 6 is a perspective view showing the paddle member of the toner cartridge according to the first embodiment.

As shown in FIGS. 2 to 6, each of the toner cartridges 200 includes: a toner storage-purpose toner cartridge body 201 formed in a shape of a hermetic container elongated in one direction and having a toner discharge port 204*a* on one end side in the longitudinal direction; a shutter 203 provided on an outer surface side of the toner cartridge body 201 for opening and closing the toner discharge port 204*a*; a screw shaft 202 provided in the toner cartridge body 201 rotatably about a rotary axis in the longitudinal direction for conveying the toner T in the toner cartridge body 201 to the toner discharge port 204*a*; a paddle member 206 having a rotary shaft 206*a* being in parallel to a rotary shaft 202*a* of the screw shaft 202 in the toner cartridge body 201 for sending the toner T in the toner cartridge body 201 toward the screw shaft 202; and a toner inflow block piece 205 coupled to a part of the paddle member 206.

In the toner cartridge 200, the toner cartridge body 201 includes a substantially rectangular parallelepiped portion 201*a*, and a projection portion 201*b* continuously provided to one end side in the longitudinal direction of the substantially rectangular parallelepiped portion 201*a*. It is to be noted that one end of the rotary shaft 202*a* of the screw shaft 202 in the toner cartridge body 201 externally projects penetrating through a sidewall of the projection portion 201*b*, and a drive gear 202*c* is attached to the one end of the rotary shaft 202*a*.

As shown in FIG. 2, the four toner cartridges 200 are attached juxtaposed to one another to a toner cartridge holder 20*x*, to structure the toner cartridge unit 20.

The toner cartridge holder 20*x* has a shape of a top-side opened container, which has four recesses partitioned by partition walls. The toner cartridges 200 are stored in the four recesses.

Further, walls on opposite sides in the longitudinal direction of each of the recesses of the toner cartridge holder 20*x* are respectively provided with a window into which the drive gear 202C of corresponding one of the toner cartridges 200 is passed through, and a cutout to which a lock lever 20*a* is swingably attached.

By fitting the toner cartridges 200 into the recesses of the toner cartridge holder 20*x* and lifting the lock levers 20*a* of the toner cartridge holder 20X, the toner cartridge bodies 201 are shifted in the right direction (arrow F direction) and retained in a state as being pressed against a stopper plate 20*b* of the toner cartridge holder 20*x*.

Further, at a bottom wall of each of the recesses of the toner cartridge holder 20*x*, a cutout window (not shown) is formed from a position facing the toner discharge port 204*a* of corresponding one of the attached toner cartridges 200 to an edge nearby.

When the toner cartridge unit 20 is attached to the image forming apparatus, the toner cartridges 200 shift in a substantially horizontal direction relative to a toner supply pipe 105. This causes an end face of the shutter 203 to abut on a top end of the toner supply pipe 105 having passed through the cutout window, to shift the shutter 203 in the substantially horizontal direction. In this manner, the toner discharge port 204*a* is disposed at a position facing the toner supply pipe 105. Then, the toner discharge port 204*a* opens (see FIGS. 1 and 7).

It is to be noted that, the image forming apparatus is provided with a gear meshing with the drive gear on the paddle member 206 side and the drive gear on the screw shaft 202 side of each of the toner cartridges 200 to transfer torque of the drive motor.

Each of the toner cartridge bodies 201 includes therein a toner storage section 201*x* being a large capacity space where the paddle member 206 is disposed and a majority of the toner T is stored, and a toner conveying passage 201*y* being a small capacity space where the screw shaft 202 is disposed. The toner conveying passage 201*y* is adjacent to and communicates with the toner storage section 201*x*. The toner discharge port 204*a* is disposed on one end side in the longitudinal direction of the toner conveying passage 201*y*.

The one end portion in the longitudinal direction of the toner conveying passage 201*y* is an internal space of the projection portion 201*b* of the toner cartridge body 201, which serves as a toner discharge section 204 having the toner discharge port 204*a*.

That is, the toner cartridge body 201 is formed in a shape in which the toner conveying passage 201*y* projects toward the one end in the longitudinal direction than the toner storage section 201*x* does. The toner discharge port 204*a* is disposed in the a projection space of the toner conveying passage 201*y* that projects toward the one end in the longitudinal direction than the toner storage section 201*x* does.

It is to be noted that a bottom surface of the toner storage section 201*x* and that of the toner conveying passage 201*y* are each formed into an arc shape.

The toner discharge port 204*a* is a square opening provided in the bottom of the toner discharge section 204, and it discharges the toner T conveyed by the screw shaft 202 to the outside of the toner cartridge 200.

The shutter 203 is a substantially square plate-like shutter provided so as to be slidable to a position where the toner discharge port 204*a* is closed. The shutter 203 opens the toner discharge port 204*a* when the toner cartridge 200 is attached to the image forming apparatus.

In a state before the toner cartridge 200 is attached to the image forming apparatus, the shutter 203 is elastically biased in a direction to close the toner discharge port 204*a* by a not-shown spring member, for example.

The paddle member 206 includes the rotary shaft 206*a* and one rectangular agitating blade 206*b* attached to the rotary shaft 206*a*.

One end of the rotary shaft 206*a* rotatably penetrates through the sidewall on one end side in the longitudinal direction of the toner cartridge body 201 in the toner storage section 201*x*, and a not-shown drive gear is attached to the one end.

Another end of the rotary shaft 206*a* is rotatably fitted into and supported by a recess provided in the sidewall on another end side in the longitudinal direction of the toner cartridge body 201 in the toner storage section 201*x*.

The agitating blade 206*b* is formed of a flexible sheet member such as a resin sheet (e.g., a PET sheet), a rubber sheet, or the like, which possesses appropriate combination of bendability and rigidity. A length of the agitating blade 206*b* is slightly shorter than that of the toner storage section 201*x*, and the agitating blade 206*b* is wide enough to slidingly contact with the bottom surface of the toner storage section 201.

An paddle member 207 loosens the toner T in the toner storage section 201*x* by the rotation of the rotary shaft 206*a* in an arrow E direction, and sends the loosened toner T into the toner conveying passage 201*y*.

The screw shaft 202 is an auger screw including the rotary shaft 202*a* and a helical blade 202*b* attached to the rotary shaft 202*a*, the helical blade 202*b* having a radial dimension so as to be accommodated inside the toner discharge section 204.

As described above, the one end of the rotary shaft 202*a* is rotatably supported, whereas the other end of the rotary shaft 202*a* is rotatably fitted into and supported by a recess provided on the sidewall on other end side in the longitudinal direction of the toner cartridge body 201 in the toner conveying passage 201*y*.

Figure 7:
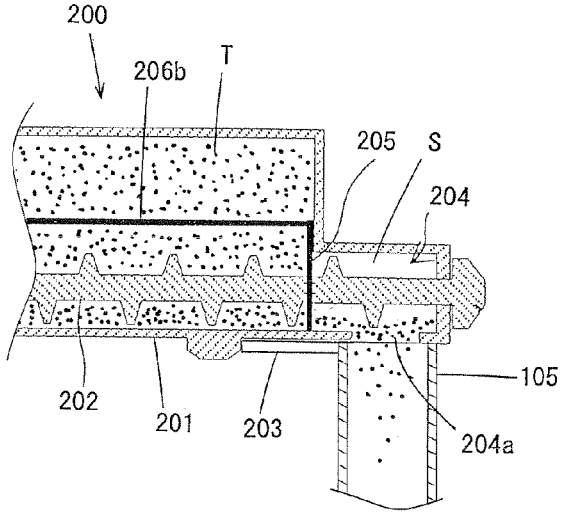
FIG. 7 is an explanatory illustration showing a state where the toner cartridge according to the first embodiment is attached to the image forming apparatus.

As shown in FIGS. 3 and 5 (by solid lines), the toner inflow block piece 205 is disposed at a block position where an inflow of the toner in the toner conveying passage 201*y* toward the toner discharge port 204*a* is blocked in a state before the toner cartridge body 201 is attached to the image forming apparatus. Further, as shown in FIGS. 7 and 5 (by chain double-dashed lines), the toner inflow block piece 205 is constituted to rotate with the paddle member 206 so as to be away from the block position in a state after the toner cartridge body 201 is attached to the image forming apparatus.

As used herein, the "block position" refers to the opening of the toner discharge section 204 as the projection space which opens toward the toner storage section 201*x*. Disposition of the toner inflow block piece 205 at this block position hinders the inflow into the toner discharge section 204 of the toner T stored in the substantially rectangular parallelepiped portion 201*a* of the toner cartridge body 201, in a state before the toner cartridge 200 is attached to the image forming apparatus.

The toner inflow block piece 205 is disposed projectively in a direction perpendicular to the rotary shaft 202*a* of the screw shaft 202 at an end on the toner discharge port 204*a* side of the agitating blade 206*b* of the paddle member 206, and the toner inflow block piece 205 includes a cutout recess 205*a* that is fitted with the rotary shaft 202*a* of the screw shaft 202.

More specifically, in the present case of the first embodiment, the agitating blade 206*b* of the paddle member 206 and the toner inflow block piece 205 are integrally formed with a flexible sheet member such as a PET sheet, for example.

In this case, one short side of the rectangular flexible sheet member is folded. Then, the folded portion is cut off substantially in half. An outer circumference at a tip of a remainder portion is cut so as to conform to a cross-sectional shape of the toner conveying passage 201*y* in the toner cartridge body 201 and so as to form the cutout recess 205*a*.

Thus, the toner inflow block piece 205 is formed having an end folded, which end is to be disposed on the toner discharge section 204 side of the agitating blade 206*b* of the paddle member 206.

It is to be noted that the cutout recess 205*a* is in a shape having a circular depth portion whose diameter is substantially identical to that of the rotary shaft 202*a* of the screw shaft 202, and a sectorial opening whose width becomes slightly narrower than the diameter of the circular depth portion from an outer side to an inner side of the sectorial opening.

Further, a cutout 207 is formed at a boundary portion between the agitating blade 206*b* and the toner inflow block piece 205. Here, in order to maintain the flexibility (bendability) of the agitating blade 206*b* while maintaining the integration of the agitating blade 206*b* and the toner inflow block piece 205, a length of the cutout 207 is set to be longer than that of a joint portion 207*a* between the agitating blade 206*b* and the toner inflow block piece 205.

As shown in FIGS. 3 and 5, in the toner cartridge 200 thus constituted, the agitating blade 206*b* of the paddle member 206 is positioned at an initial position thereof on the screw shaft 202 side, and the cutout recess 205*a* of the toner inflow block piece 205 is positioned at an initial position thereof to be fitted with the rotary shaft 202*a* of the screw shaft 202, in a state before the toner cartridge 200 is attached to the image forming apparatus.

Here, the toner inflow block piece 205 is attached to the rotary shaft 202*a* as being brought into close contact with an opening edge of the toner discharge section 204 and the helical blade 202*b*.

Thus, though the opening of the toner discharge section 204 is mostly closed by the toner inflow block piece 205, because the toner inflow block piece 205 has the cutout recess 205*a*, a part of the opening of the toner discharge section 204 is not closed.

However, as the opening of the toner discharge section 204 is mostly closed by the toner inflow block piece 205, even in a case where the toner cartridge 200 is stored or transported with the toner discharge section 204 facing downward, the toner T becomes less prone to flow into the toner discharge section 204 as compared to a case where the toner inflow block piece 205 is not provided, and a space S becomes more likely to be created in the toner discharge section 204.

As a result, the toner T around the toner discharge port 204*a* will not be flocculated nor will it form lumps under any pressure, and hence the toner discharge port 204*a* will not be clogged.

Accordingly, when the toner cartridge holder 20*x* having the toner cartridges 200 each having the space S in the toner discharge section 204 is attached to the image forming apparatus, as shown in FIG. 7, the shutter 203 opens and the toner T in the toner discharge section 204 drops into the toner supply pipe 105, whereby the space S in the toner discharge section 204 is increased.

In a drive mode of the image forming apparatus, as shown in FIGS. 4 and 5, when the rotary shaft 206*a* of the paddle member 206 rotates in the arrow E direction, the agitating blade 206*b* rotates upward from the initial position, and thereafter, the agitating blade 206*b* elastically deforms and rotates while having its tip be brought into sliding contact with an inner wall surface of the toner cartridge body 201. In this manner, the agitating blade 206*b* scoops the toner in the toner storage section 201 while loosening the toner, to send the toner to the toner conveying passage 201*y*.

At this time, the toner inflow block piece 205 integrated with the agitating blade 206*b* also moves upward from the initial position, and departs from the rotary shaft 202*a* of the screw shaft 202. Thus, the opening of the toner discharge section 204 is fully opened.

Further, the joint portion between the agitating blade 206*b* and the toner inflow block piece 205 is shortened by the cutout 207. Because this joint portion elastically deforms in a twist direction of the toner inflow block piece 205, the toner inflow block piece 205 also rotates while being brought into sliding contact with the inner wall surface of the toner cartridge body 201 without interfering with the rotation of the agitating blade 206*b*.

On the other hand, in the drive mode of the image forming apparatus, the screw shaft 202 rotates as well, to convey the toner in the toner conveying passage 201*y* toward the toner discharge section 204.

At this time, though there exists a certain amount of toner in the toner discharge section 204, the toner is not flocculated nor will it form lumps. In addition thereto, the space S also exists above the toner. Therefore, the toner in the toner discharge section 204 is fully loosened by the rotating helical blade 202*b* and drops from the toner discharge port 204*a*, to be supplied into the developing device 102 through the toner supply pipe 105. The toner in the toner conveying passage 201*y* is also successively sent to the toner discharge section 204.

(Second Embodiment)

Figure 8:
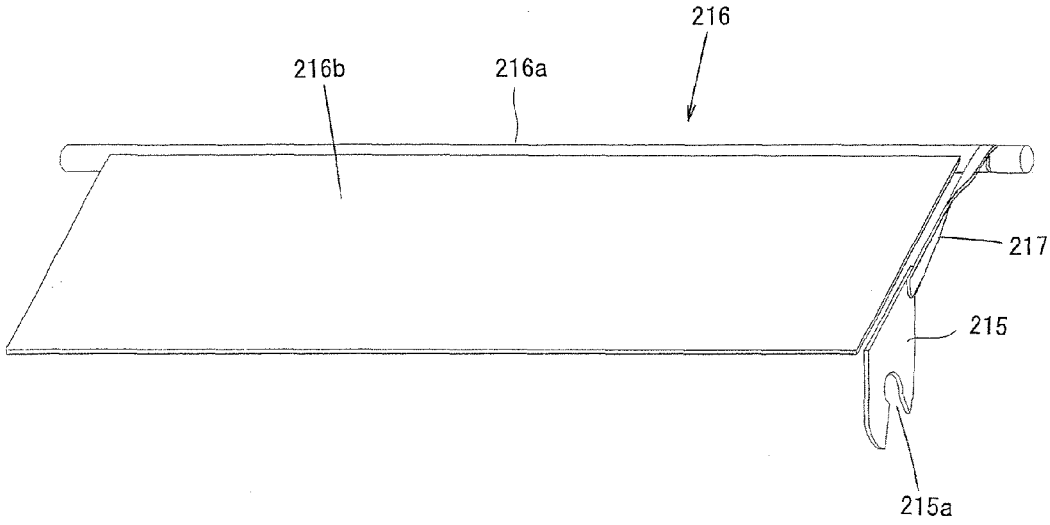
FIG. 8 is a perspective view showing a paddle member and a toner inflow block piece according to a second embodiment of the present invention.
Figure 9A:
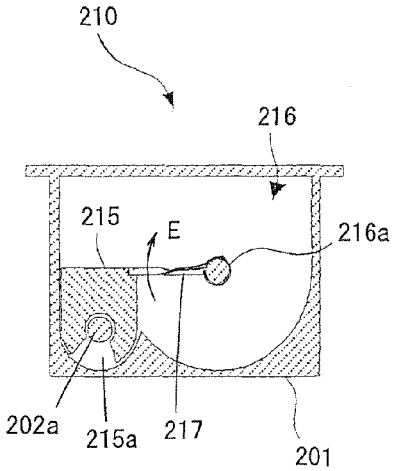
FIGS. 9(A) and 9(B) are cross-sectional views each showing initial positions of the paddle member and the toner inflow block piece according to the second embodiment.
Figure 9B:
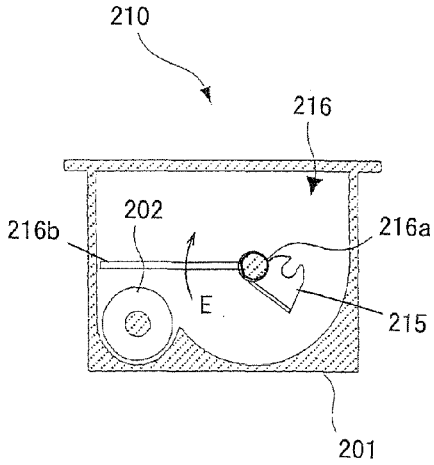
Figure 10:
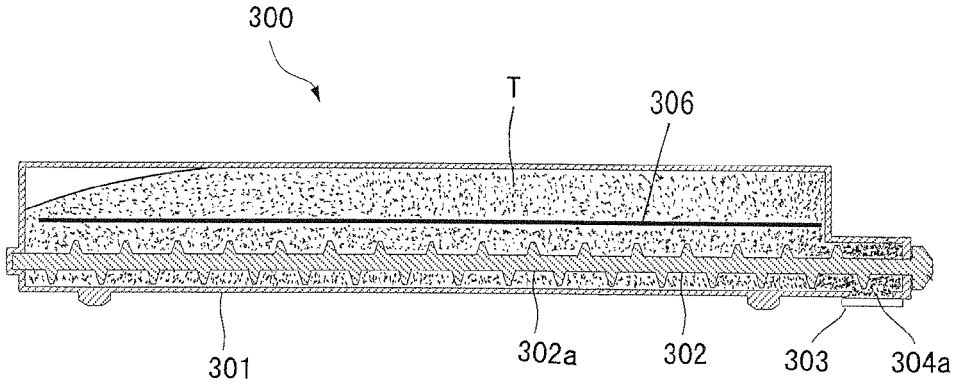
FIG.10 PRIOR ART
FIG. 10 is a side cross-sectional view showing a state before a conventional toner cartridge is attached to an image forming apparatus.

FIG. 8 is a perspective view showing a paddle member and a toner inflow block piece according to a second embodiment of the present invention. FIGS. 9(A) and 9(B) are cross-sectional views each showing initial positions of the paddle member and the toner inflow block piece according to the second embodiment. In FIGS. 9(A) and 9(B), like elements as those in FIGS. 4 and 5 are denoted by identical reference numerals and characters.

A toner cartridge according to the second embodiment, which is not shown, is the same as the toner cartridge according to the first embodiment in that a toner inflow block piece 215 has a cutout recess 215*a* that fits with the rotary shaft 202*a* of the screw shaft 202. The difference from the first embodiment lies in that the toner inflow block piece 215 is formed separately from an agitating blade 216*b* of a paddle member 216, and is coupled to a part of the paddle member 216 by a tape 217 or a strap made of a resin, for example.

The rest of the constitution of the toner cartridge according to the second embodiment is identical to that according to the first embodiment.

Specifically, the toner inflow block piece 215 is coupled to the rotary shaft 216*a* of the paddle member 216 by the tape 217 or the strap.

Here, in the toner cartridge body 201, one end of the tape 217 or the strap is fixed on the toner discharge section side of the rotary shaft 216*a* by adhesion or the like, and another end thereof adheres to an edge opposite to the cutout recess 215*a* of the toner inflow block piece 215.

As shown in FIGS. 9(A) and 9(B), also in the toner cartridge according to the second embodiment thus constituted, before being attached to the image forming apparatus, the agitating blade 216*b* of the paddle member 216 is disposed at the initial position on the screw shaft 202 side, and the cutout recess 215*a* of the toner inflow block piece 215 is disposed at the initial position fitted with the rotary shaft 202*a* of the screw shaft 202. Additionally, the toner inflow block piece 215 is attached to the rotary shaft 202*a* as being brought into close contact with the opening edge of the toner discharge section and the helical blade 202*b*.

It is to be noted that, an adhesive may be applied to a portion in the toner inflow block piece 215 which is brought into contact with the opening edge of the toner discharge section, in order to prevent the toner inflow block piece 215 from wavering on the rotary shaft 202*a*.

Thus, because the opening of the toner discharge section is mostly closed by the toner inflow block piece 215, similarly to the first embodiment, even in a case where the toner cartridge is stored or transported with the toner discharge section facing downward, the toner becomes less prone to flow into the toner discharge section as compared to a case where the toner inflow block piece 215 is not provided, and a space is more likely to be created in the toner discharge section.

As a result, the toner around the toner discharge port will not be flocculated nor will it form lumps under any pressure, and hence the toner discharge port will not be clogged.

Then, as shown in FIGS. 9(A) and 9(B), in the driving mode of the age forming apparatus, as the rotary shaft 216*a* of the paddle member 216 rotates in the arrow E direction, the tape 217 or the strap is taken up by the rotary shaft 216*a*, whereby the toner inflow block piece 215 is pulled toward the rotary shaft 216*a* and departs from the rotary shaft 202*a* of the screw shaft 202. Thus, the opening of the toner discharge section 204 is fully opened.

In this case, because the toner inflow block piece 215 is finally drawn to the rotary shaft 216*a* of the paddle member 216, it will not interfere with the rotation of the agitating blade 216*b* at all.

What is claimed is:

1. A toner cartridge, comprising:

a toner cartridge body formed into a shape of a hermetic container elongated in one direction and having a toner discharge port on an one end side in a longitudinal direction of the toner cartridge body;

a shutter provided on an outer surface side of the toner cartridge body for opening and closing the toner discharge port;

a screw shaft provided in the toner cartridge body rotatably about a rotary shaft in the longitudinal direction for conveying a toner in the toner cartridge body to the toner discharge port;

a paddle member for sending the toner in the toner cartridge body toward the screw shaft, the paddle member having in the toner cartridge body a rotary shaft being in parallel to the rotary shaft of the screw shaft and an agitating blade attached to the rotary shaft; and a toner inflow block piece coupled to a part of the paddle member, wherein the toner cartridge body includes therein a toner storage section being a large-capacity space where the paddle member is disposed and most of the toner is stored; and a toner conveying passage being a small-capacity space where the screw shaft is disposed, the toner conveying passage being adjacent to and communicating with the toner storage section and having the toner discharge port disposed on one end side in a longitudinal direction of the toner conveying passage, the toner inflow block piece is disposed at a block position where an inflow of the toner in the toner conveying passage toward the toner discharge port is blocked while the toner cartridge body is yet to be attached to an image forming apparatus, and rotates together with the paddle member so as to be away from the block position while the toner cartridge body is attached to the image forming apparatus;

wherein the toner inflow block piece is disposed at an end on a toner discharge port side of the agitating blade of the paddle member so as to project in a direction perpendicular to the rotary shaft of the screw shaft and has a cutout recess for the rotary shaft of the screw shaft to fit in.

2. The toner cartridge according to claim 1, wherein the toner cartridge body is formed into a shape in which the toner conveying passage projects toward the one end side in the longitudinal direction farther than the toner storage section does, the toner discharge port is disposed in a projection space of the toner conveying passage projecting toward the one end side in the longitudinal direction farther than the toner storage section does, and the block position of the toner inflow block piece is located at an opening of the projection space, the opening facing the toner storage section.

3. The toner cartridge according to claim 1, wherein the agitating blade of the paddle member and the toner inflow block piece are integrally formed with a flexible sheet member.

4. The toner cartridge according to claim 3, wherein the toner inflow block piece is formed by folding an end of the agitating blade of the paddle member, and a cutout is formed at a boundary portion between the agitating blade and the toner inflow block piece.

5. The toner cartridge according to claim 4, wherein a length of the cutout is longer than that of a joint portion between the agitating blade and the toner inflow block piece.

6. The toner cartridge according to claim 1, wherein the toner inflow block piece has a cutout recess for the rotary shaft of the screw shaft to fit in, and is coupled to a part of the paddle member by a tape or a strap.

7. The toner cartridge according to claim 6, wherein the toner inflow block piece is coupled to the rotary shaft of the paddle member by a tape or a strap.

8. An image forming apparatus, comprising:

a photoconductor drum that is to have an electrostatic latent image formed on a surface thereof;

a developing section for supplying a toner to the electrostatic latent image on the surface of the photoconductor drum to form a toner image;

a toner cartridge according to claim 1 for supplying the toner to the developing section;

a transferring section for transferring the toner image on the surface of the photoconductor drum to a recording medium; and a fusing section for fusing the toner image on the recording medium.

9. A toner cartridge, comprising:

a toner cartridge body formed into a shape of a hermetic container elongated in one direction and having a toner discharge port on one end side in a longitudinal direction of the toner cartridge body;

a shutter provided on an outer surface side of the toner cartridge body for opening and closing the toner discharge port;

a screw shaft provided in the toner cartridge body rotatably about a rotary shaft in the longitudinal direction for conveying a toner in the toner cartridge body to the toner discharge port;

a paddle member for sending the toner in the toner cartridge body toward the screw shaft, the paddle member having in the toner cartridge body a rotary shaft being in parallel to the rotary shaft of the screw shaft and an agitating blade attached to the rotary shaft; and a toner inflow block piece coupled to a part of the paddle member, wherein the toner cartridge body includes therein a toner storage section being a large-capacity space where the paddle member is disposed and most of the toner is stored; and a toner conveying passage being a small-capacity space where the screw shaft is disposed, the toner conveying passage being adjacent to and communicating with the toner storage section and having the toner discharge port disposed on one end side in a longitudinal direction of the toner conveying passage, the toner inflow block piece is disposed at a block position where an inflow of the toner in the toner conveying passage toward the toner discharge port is blocked while the toner cartridge body is yet to be attached to an image forming apparatus, and rotates together with the paddle member so as to be away from the block position while the toner cartridge body is attached to the image forming apparatus;

wherein the agitating blade of the paddle member and the toner inflow block piece are integrally formed with a flexible sheet member;

wherein the toner inflow block piece is formed by folding an end of the agitating blade of the paddle member, and a cutout is formed at a boundary portion between the agitating blade and the toner inflow block piece.

10. The toner cartridge according to claim 9, wherein the toner inflow block piece is disposed at an end on a toner discharge port side of the agitating blade of the paddle member so as to project in a direction perpendicular to the rotary shaft of the screw shaft and has a cutout recess for the rotary shaft of the screw shaft to fit in.

11. The toner cartridge according to claim 9, wherein a length of the cutout is longer than that of a joint portion between the agitating blade and the toner inflow block piece.

12. The toner cartridge according to claim 9, wherein the toner cartridge body is formed into a shape in which the toner conveying passage projects toward the one end side in the longitudinal direction farther than the toner storage section does, the toner discharge port is disposed in a projection space of the toner conveying passage projecting toward the one end side in the longitudinal direction farther than the toner storage section does, and the block position of the toner inflow block piece is located at an opening of the projection space, the opening facing the toner storage section.

13. The toner cartridge according to claim 9, wherein the toner inflow block piece has a cutout recess for the rotary shaft of the screw shaft to fit in, and is coupled to a part of the paddle member by a tape or a strap.

14. The toner cartridge according to claim 13, wherein the toner inflow block piece is coupled to the rotary shaft of the paddle member by a tape or a strap.

15. An image forming apparatus, comprising:

a photoconductor drum that is to have an electrostatic latent image formed on a surface thereof;

a developing section for supplying a toner to the electrostatic latent image on the surface of the photoconductor drum to form a toner image;

a toner cartridge according to claim 9 for supplying the toner to the developing section;

a transferring section for transferring the toner image on the surface of the photoconductor drum to a recording medium; and a fusing section for fusing the toner image on the recording medium.

* * * * *